US008443530B2

(12) United States Patent
Pender

(10) Patent No.: US 8,443,530 B2
(45) Date of Patent: May 21, 2013

(54) ICE RESURFACING SLED

(75) Inventor: John G. Pender, Fairbanks, AK (US)

(73) Assignee: Holaday-Parks-Fabricators, Inc., Seattle, WA (US)

( * ) Notice: Subject to any disclaimer, the term of this patent is extended or adjusted under 35 U.S.C. 154(b) by 308 days.

(21) Appl. No.: 12/940,899

(22) Filed: Nov. 5, 2010

(65) Prior Publication Data

US 2011/0146111 A1 Jun. 23, 2011

Related U.S. Application Data

(60) Provisional application No. 61/288,005, filed on Dec. 18, 2009.

(51) Int. Cl.
*E01H 4/00* (2006.01)

(52) U.S. Cl.
USPC ..... 37/219

(58) Field of Classification Search
USPC 37/219–228, 241, 197; 299/24; 126/271.2 B, 126/271.2 R; 414/569; 404/90, 91
See application file for complete search history.

(56) References Cited

U.S. PATENT DOCUMENTS

| | | | | |
|---|---|---|---|---|
| 1,029,508 | A * | 6/1912 | Parker | 37/219 |
| 1,526,903 | A * | 2/1925 | Connolly | 37/197 |
| 1,837,030 | A * | 12/1931 | Elze | 126/271.2 B |
| 2,642,679 | A | 6/1953 | Zamboni | |
| 2,763,939 | A | 9/1956 | Zamboni | |
| 3,291,118 | A * | 12/1966 | Wilson | 126/271.2 R |
| 3,311,104 | A | 3/1967 | Wollner | |
| 4,918,844 | A * | 4/1990 | Marsh | 37/197 |
| 6,138,387 | A | 10/2000 | Fox | |
| 6,644,301 | B2 | 11/2003 | Farone | |
| 7,380,355 | B2 * | 6/2008 | Donaldson | 37/219 |
| 2007/0187119 | A1 | 8/2007 | Fawcett | |

FOREIGN PATENT DOCUMENTS

| | | |
|---|---|---|
| CA | 692617 | 8/1964 |
| CA | 926117 | 5/1973 |
| CA | 2351946 A1 | 12/2002 |
| CA | 2384457 C | 8/2010 |

* cited by examiner

*Primary Examiner* — Robert Pezzuto
(74) *Attorney, Agent, or Firm* — Christensen O'Connor Johnson Kindness PLLC

(57) ABSTRACT

An ice resurfacing sled including a fuel source directing fuel to a manifold which distributes it under a regulated pressure to a plurality of orifices where it is burned in expansion chambers. The hot gas flows into a melting chamber formed by a top surface, two lateral sled runners and the surface of the ice to be melted. The melting chamber is shaped to have a reduced cross sectional area near its rear outlet to assist in maintaining the flow of heated gas beneath the sled to optimize melting. A wind screen is provided at the rear of the sled to prevent tail winds from disrupting the flow of hot gas through the melting chamber.

18 Claims, 12 Drawing Sheets

ICE RESURFACING SLED

CROSS-REFERENCE TO RELATED APPLICATION

This application claims the benefit of Provisional Application No. 61/288,005, filed Dec. 18, 2009, the subject matter of which is also incorporated herein by reference.

BACKGROUND

The present invention relates to equipment for smoothing the surface of ice, particularly the surfaces of indoor and outdoor skating rinks. The industry standard for ice rink resurfacing is a machine called a Zamboni, which was patented in the 1950s (U.S. Pat. Nos. 2,642,679 and 2,763,939). Zambonis operate by conditioning the roughened ice surface before it is flooded with clean water which is then allowed to freeze. Resurfacing is done in a single pass; but the machines are very costly, and a need exists for less expensive equipment. In the northern United States and Canada there are a great many seasonal outdoor ice rinks, very few of which are resurfaced using a Zamboni for a variety of reasons including cost, the need to store a Zamboni inside at a temperature above freezing, and the substantial weight of the machine which makes it impractical to use on the surface of a pond or lake where the ice may vary in thickness. There are other ice resurfacers that are smaller in size but, again, operate by spreading a thin layer of water onto a surface and allowing it to freeze (see U.S. Pat. No. 6,138,387, for example). Many ice rinks, however, do not have convenient access to water. In addition, the concept of resurfacing ice by melting it and allowing it to refreeze is known as shown in Canadian Patent No. 692,617; U.S. Pat. No. 6,644,301; and U.S. Patent Application Publication No. 2007/0187119 A1. For various reasons, none of these devices have proven to be a practical solution to the described problem.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An ice resurfacer is disclosed capable of applying heated gas directly to the surface of ice beneath the machine to cause it to melt. The ice resurfacer includes a sled-like structure mounting a fuel source such as a propane tank and means for directing the fuel to a plurality of burners mounted adjacent the front portion of the sled and adapted to direct heated gas through expansion chambers to a melting chamber positioned beneath the sled. The expansion chambers and the melting chamber are uniquely shaped to control gas flow to optimize fuel consumption and ice melting.

A pivoting windscreen and melt water spreader is positioned on the rear of the sled.

DESCRIPTION OF THE DRAWINGS

The foregoing aspects and many of the attendant advantages of this invention will become more readily appreciated as the same become better understood by reference to the following detailed description, when taken in conjunction with the accompanying photographs and drawings, wherein.

DETAILED DESCRIPTION

Figure 1:
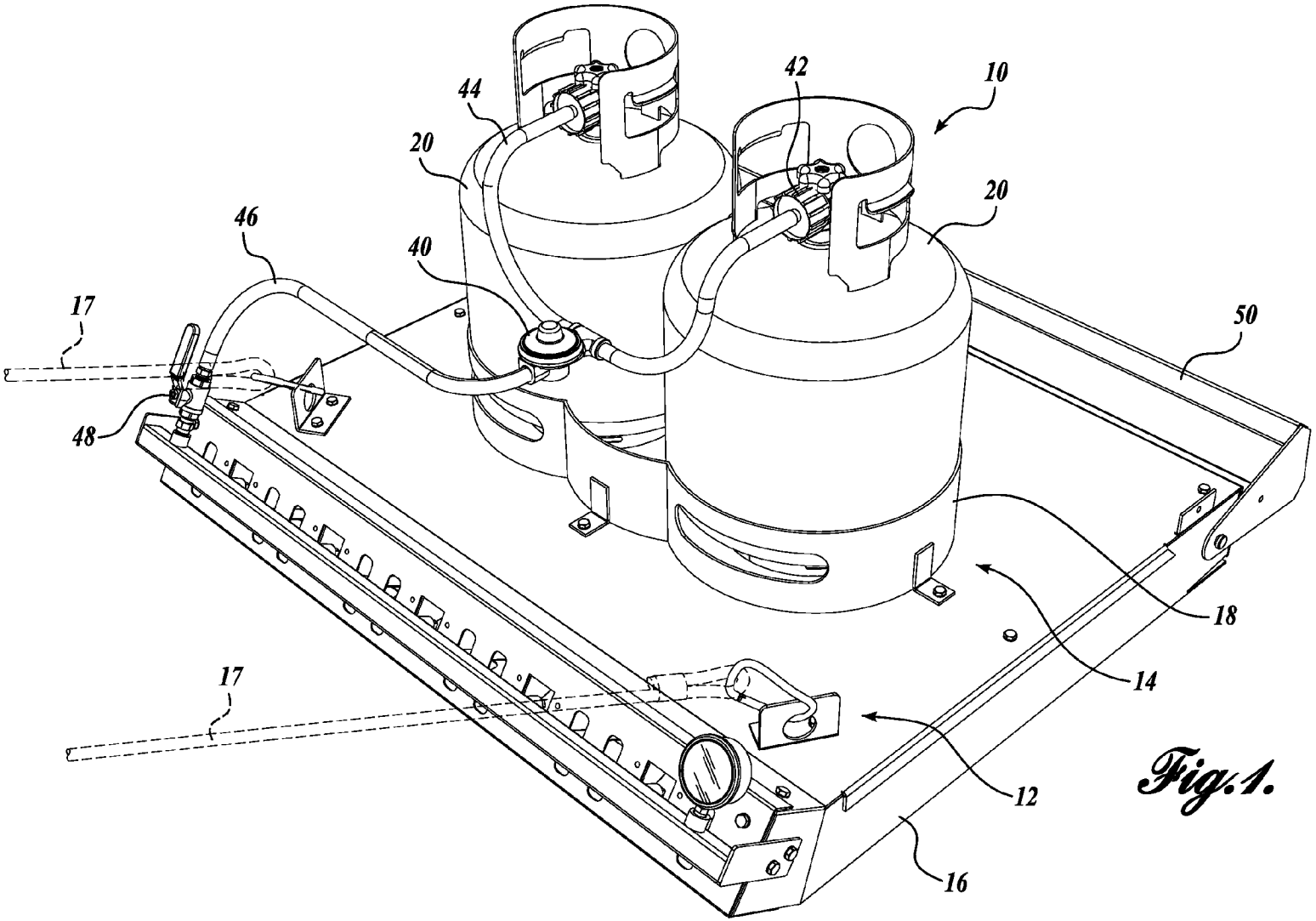
FIG. 1 is a perspective view of an ice resurfacer made according to the present invention.
Figure 2:
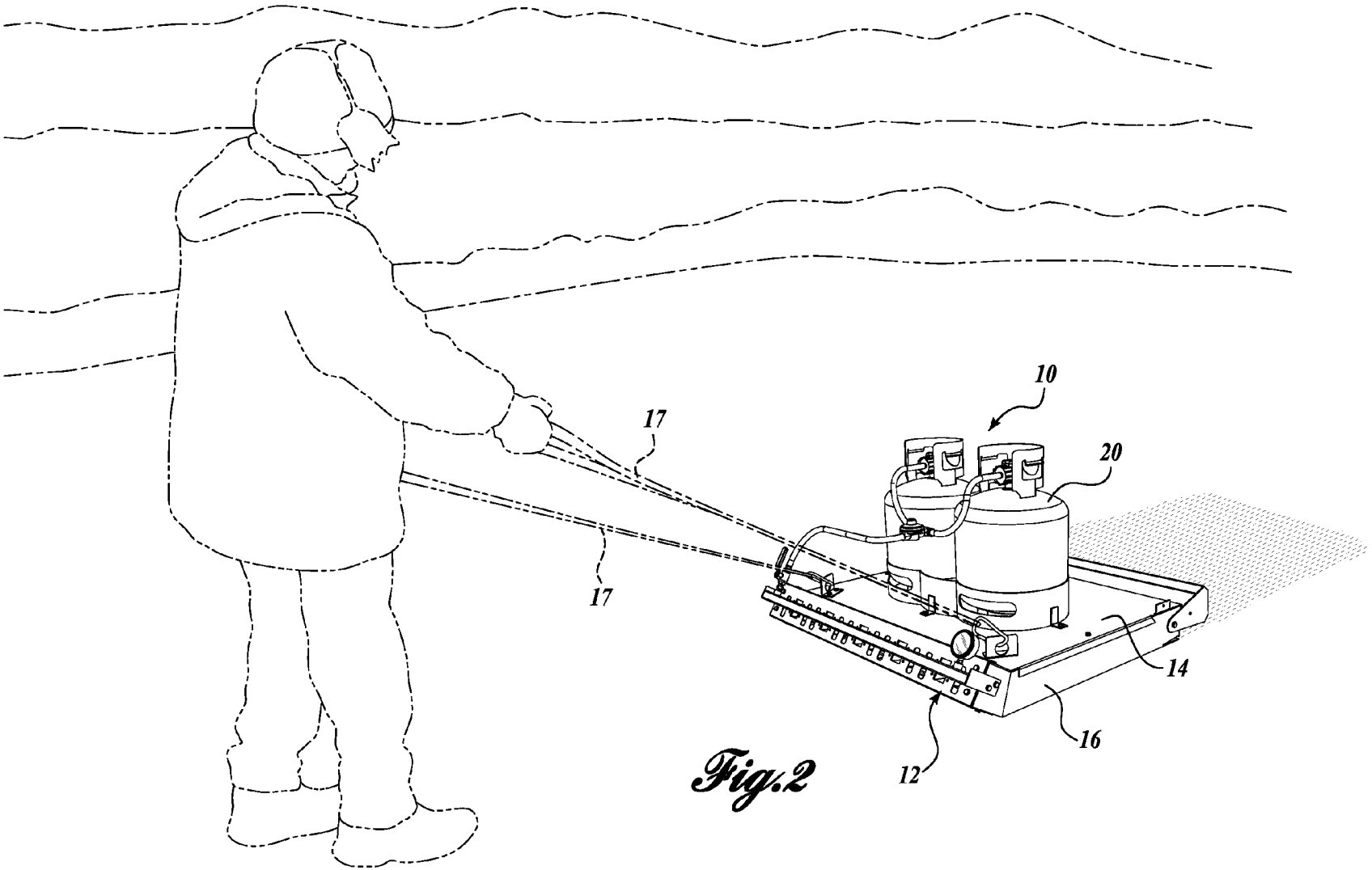
FIG. 2 is a perspective view of the ice resurfacer of FIG. 1 showing an operator guiding the ice resurfacer by means of steering cords.

Referring initially to FIGS. 1 and 2, ice resurfacer 10 is disclosed to comprise a sled 12 having a top plate 14 and a pair of parallel spaced runners 16 (one visible) positioned to extend downwardly from the lateral sides of top plate 14. Guide ropes 17 are shown connected to opposite sides of top plate 14 to allow the operator to both pull the sled 12 across the ice and guide its path of travel. Alternatively, a rigid handle may be substituted for the guide ropes, but the ropes have the advantage of compactness when storing or transporting the device.

Figure 3:
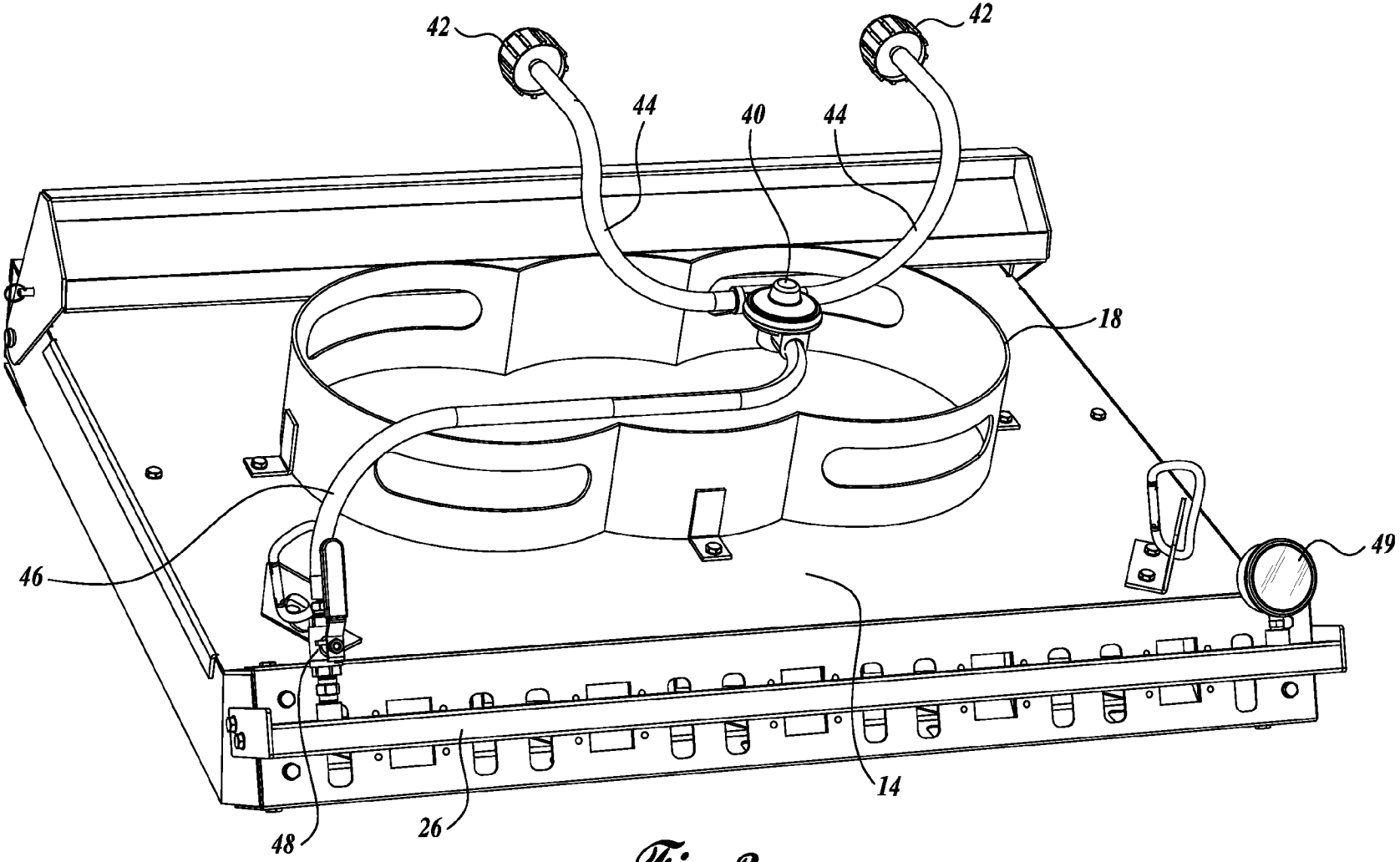
FIG. 3 is a top perspective view of the ice resurfacer of FIG. 1 with the propane tanks removed.
Figure 4A:
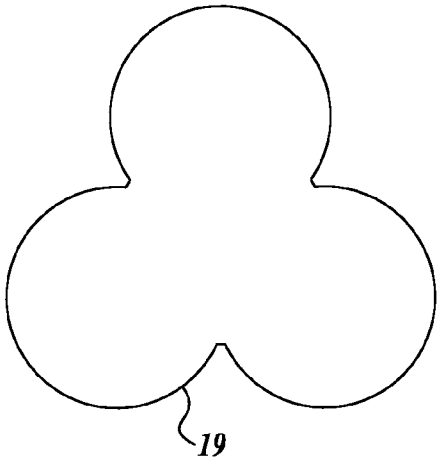
FIGS. 4A-4D show schematic views of an alternate form of propane tank mounting bracket capable of mounting one, two, or three tanks.
Figure 4B:
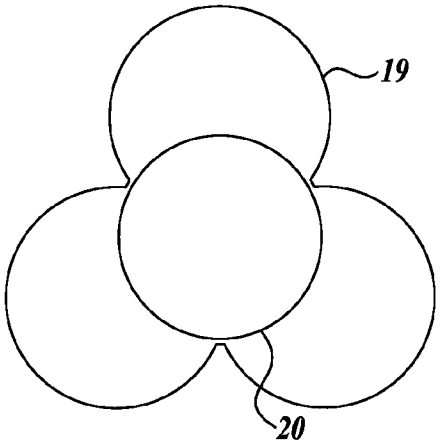
Figure 4C:
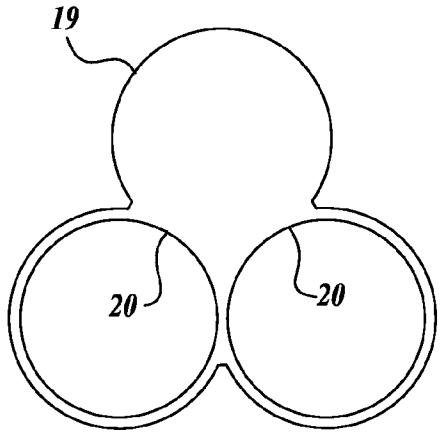
Figure 4D:
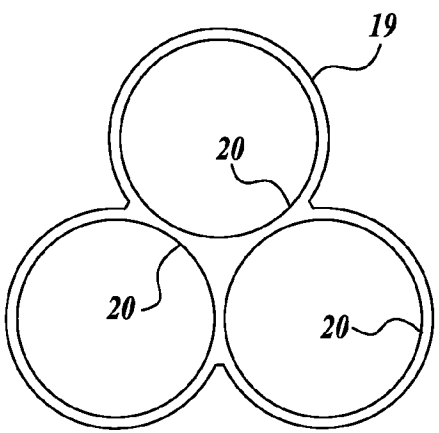

Turning additionally to FIG. 3, fuel source mounting bracket 18 is shown bolted to top plate 14 of sled 12, although it will be understood that any other suitable method for attaching the bracket, such as by welding, may also be used. In FIG. 3, mounting bracket 18 is shaped to hold either one centered propane tank or two laterally spaced propane tanks 20, but it will be understood that mounting bracket 18 could be formed to hold a greater or lesser number of propane tanks or containers for other types of gas or liquid fuel. For example, FIG. 4A discloses a form of mounting bracket 19 capable of mounting one, two, or three tanks 20. As shown, FIG. 4 illustrate bracket 19 when empty (FIG. 4A) and when holding one (FIG. 4B), two (FIG. 4C), and three (FIG. 4D) tanks 20, respectively. While a propane fuel source is shown with appropriate modification of the device, fuel sources such as natural gas or liquid fuels may alternatively be used to generate ice melting heated gas.

As illustrated in FIGS. 1 and 2, two 20-pound propane tanks 20 are shown mounted in mounting bracket 18. For reasons discussed hereafter, this has been found to be a suitable arrangement for use in connection with outdoor ice rinks. For indoor rinks, the mounting bracket is formed to hold a single 20-pound propane tank, for example, or a single 30-pound tank.

A propane storage tank contains liquid propane in its bottom portion and propane gas there above. At equilibrium, when a propane tank valve is closed, the pressure of the propane gas depends only on temperature and is independent of the amount of propane in the tank as long as there is at least some liquid present. At equilibrium, a full tank has exactly the same inside pressure as a nearly empty tank when both are at the same temperature. Thus, the amount of gas available to be removed from a tank is also dependent on the temperature of the tank. The warmer the tank, the more propane molecules pass from the liquid to gas state. When gas is vented out of the tank, the liquid propane will tend to evaporate as the gas pressure drops. More propane molecules leave the liquid phase than enter the liquid phase, thus causing the temperature of the liquid propane to cool. As the liquid cools, the rate that liquid propane molecules evaporate drops, the net result being that there is less propane gas available to be withdrawn.

The physics of propane has, in the past, made it difficult to melt ice with a propane flame for an extended period of time since, as gas is withdrawn from the tank, the liquid propane cools, reducing the rate of evaporation and, consequently, producing insufficient gas to efficiently melt ice in a reasonable time period. Partially countering this problem is the fact that as the propane tank cools below ambient air temperature, heat from the warmer ambient air begins to warm the propane tank and the liquid therein. Balancing liquid evaporation, gas withdrawal, gas burn rate and consequent heat flow to efficiently melt ice is thus critical to successful operation of the present invention.

In an ice resurfacer such as that shown in FIGS. 1 and 2, it will be understood that the addition of a second propane tank increases the surface area of the liquid propane and reduces by 50% the volume of gas that each tank must produce to melt a given amount of ice, thus slowing the rate of tank cooling. Likewise, three tanks mounted in the three-tank bracket of FIG. 4 reduces the volume needed to be produced by each tank to 33⅓%. Notwithstanding such reductions in the amount of gas needed to be produced by each tank, effective ice melting over the period of time needed to resurface an ice rink requires the use of additional novel design features in the ice resurfacer.

Figure 5:
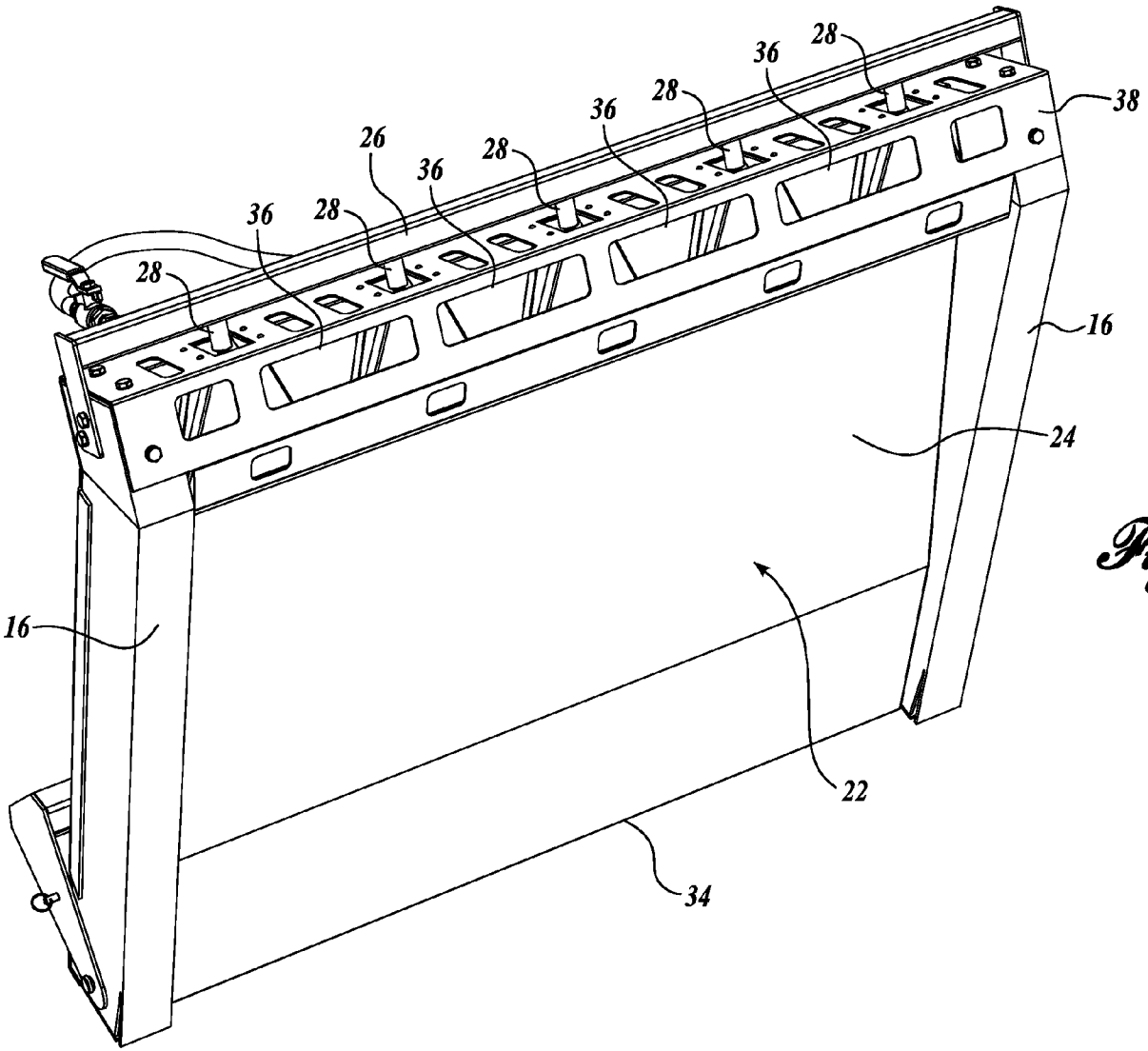
FIG. 5 is a bottom front perspective view of the ice resurfacer of FIG. 1.
Figure 6:
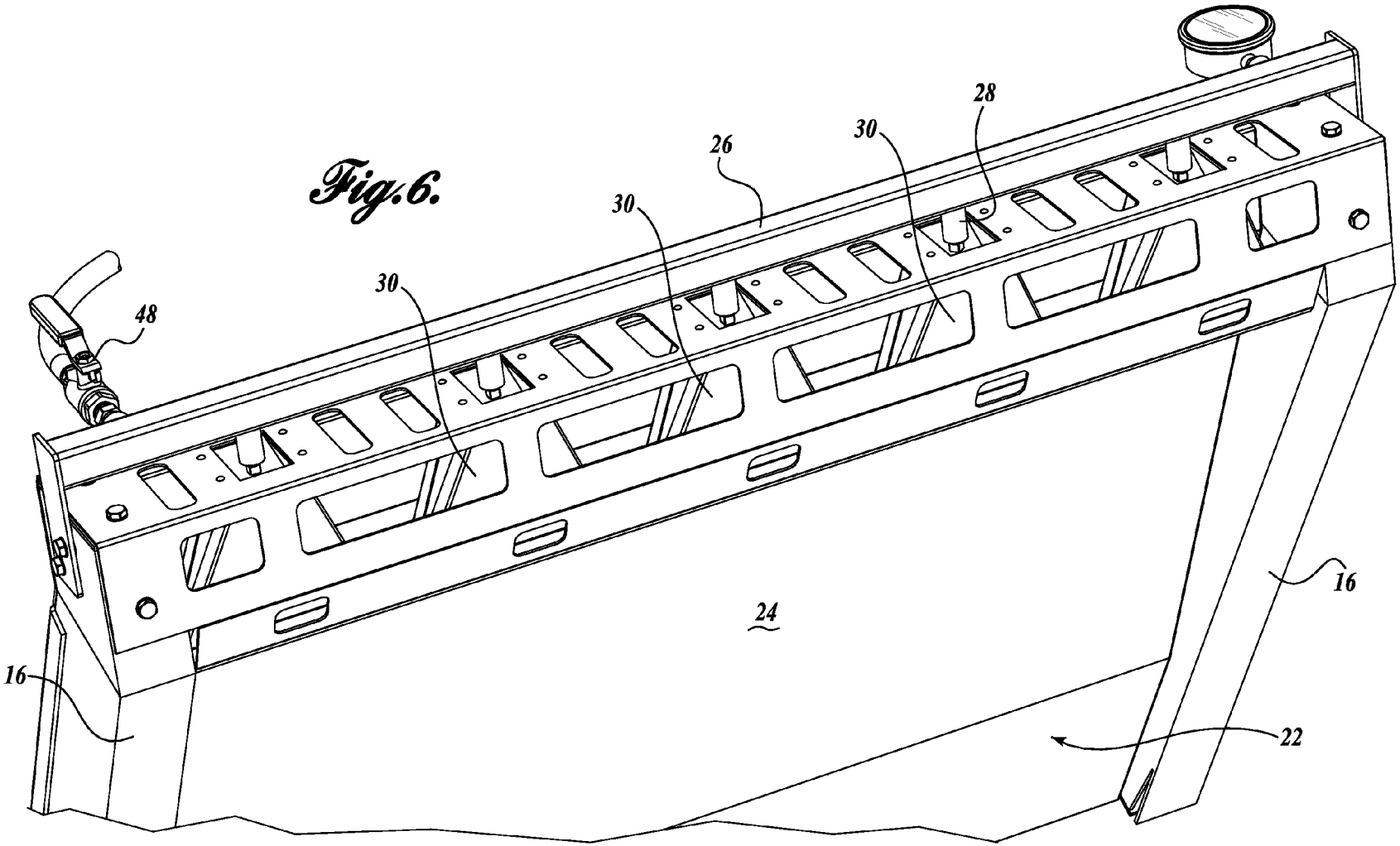
FIG. 6 is a fragmentary perspective view of a front portion of the ice resurfacer of FIG. 5 showing the gas manifold and nozzles.

Turning to FIGS. 5 an 6, melting chamber 22 is shown to be defined by top surface 24 and portions of the inside walls of opposed runners 16. Runners 16 are hollow and formed with a relatively wide base to spread the weight of the sled to avoid digging into the ice. The edges of the base are also tapered and rounded to prevent the runners from catching the ice. The runners may be air cooled by providing openings in their outside walls to allow heat to escape so that the runners do not leave grooves in the ice.

Figure 7:
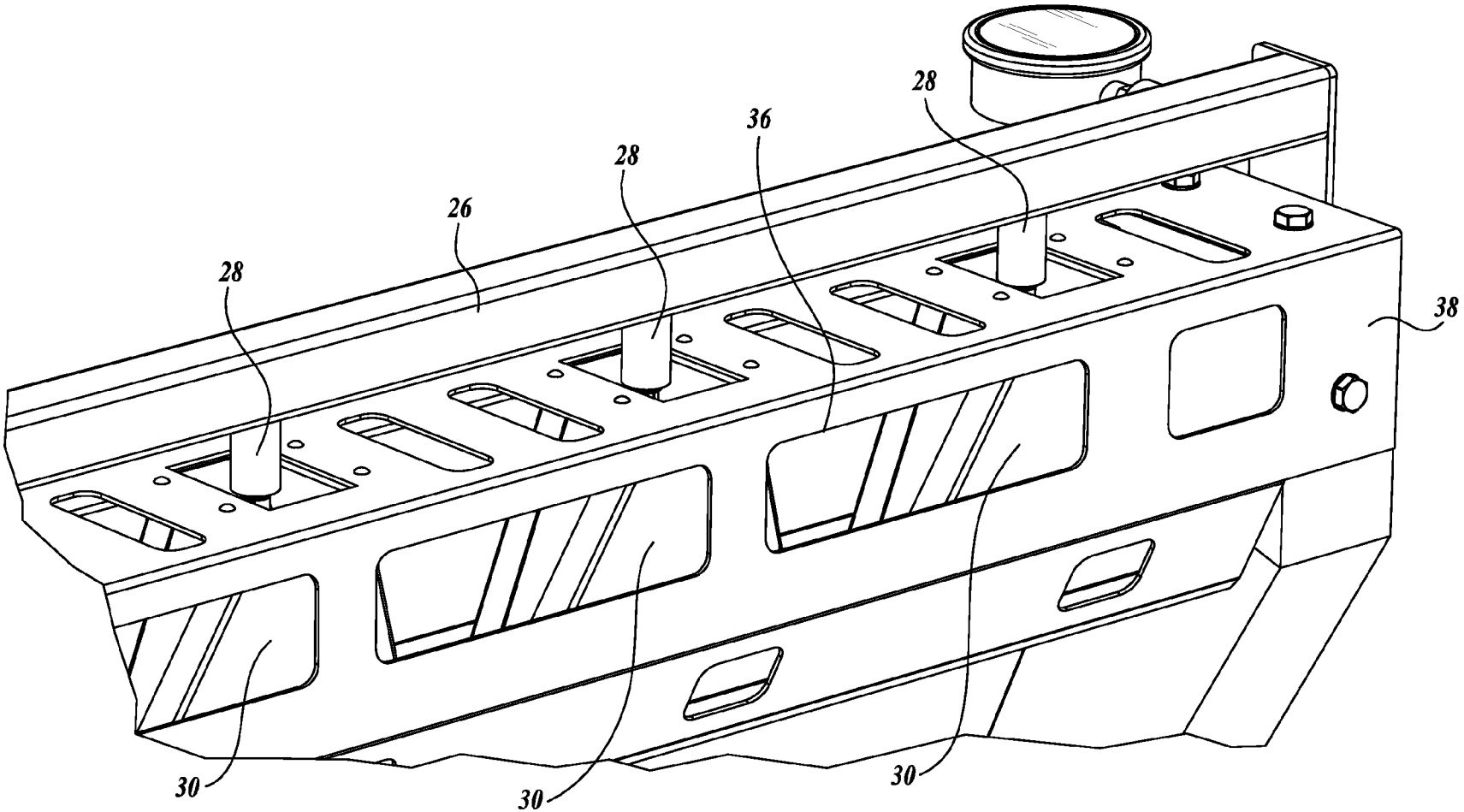
FIG. 7 is a fragmentary perspective view of a front portion of the gas manifold and nozzles of FIG. 5.

Referring, additionally, to FIG. 7, gas manifold 26 is shown to comprise a laterally extending tube having a plurality of nozzles 28 adapted to direct burning gas into the tops of expansion chambers 30. Manifold 26 is designed to have an inside diameter greater than the diameter of the connected propane delivery hose inlet. This reduces or prevents a gas pressure drop at each fuel nozzle so that gas is distributed evenly to all of the nozzles spaced along the manifold tube. Nozzles 28 may be formed by internally threading cylindrical tubes and then threading therein a plug having a square head, an Allen head, or some other head configuration, with a hole drilled therethrough, into the tube. When valve 48 (FIG. 3) is opened, gas flows into manifold 26 and through the holes in nozzles 28. The flowing gas may be ignited using a torch or match held near any nozzle, access to which may be had through openings 36. Alternatively, a conventional electric spark igniter may be used. The flame then migrates to all of the nozzles.

Figure 8:
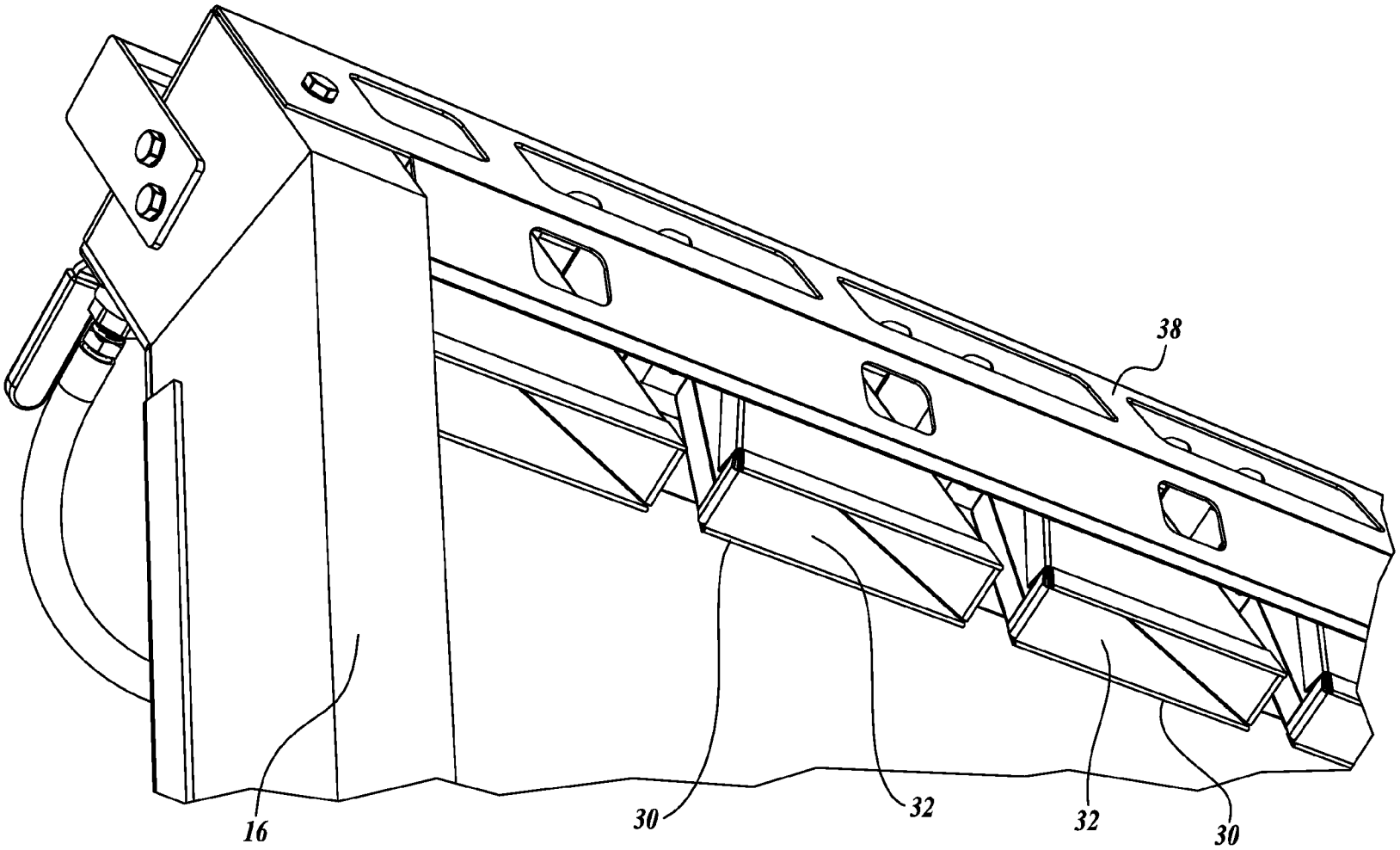
FIG. 8 is a bottom perspective view of a rear portion of the expansion chamber outlets of the ice resurfacer of FIG. 1.

The outlets 32 of expansion chambers 30 as shown in FIG. 8 are substantially larger than the upper inlets of the expansion chambers into which the ignited gas flows from the nozzles. The nozzles are centered in the upper inlets of expansion chambers 30 so that ample air is provided to ensure full and rapid gas combustion. As the burning gas flows out of the orifices and into the expansion chambers, its volume increases as the burning gas fills the expansion chambers. Combustion of the gas is substantially completed before the hot combustion gases exit the expansion chamber 30. The hot combustion gases then flow into the front end of the melting chamber 22 where it flows toward the rear of the chamber and exit 34. Expansion chambers 30 are oriented to push the heat of the flame into the ice and evenly across the length of the melting chamber 22.

Figure 10:
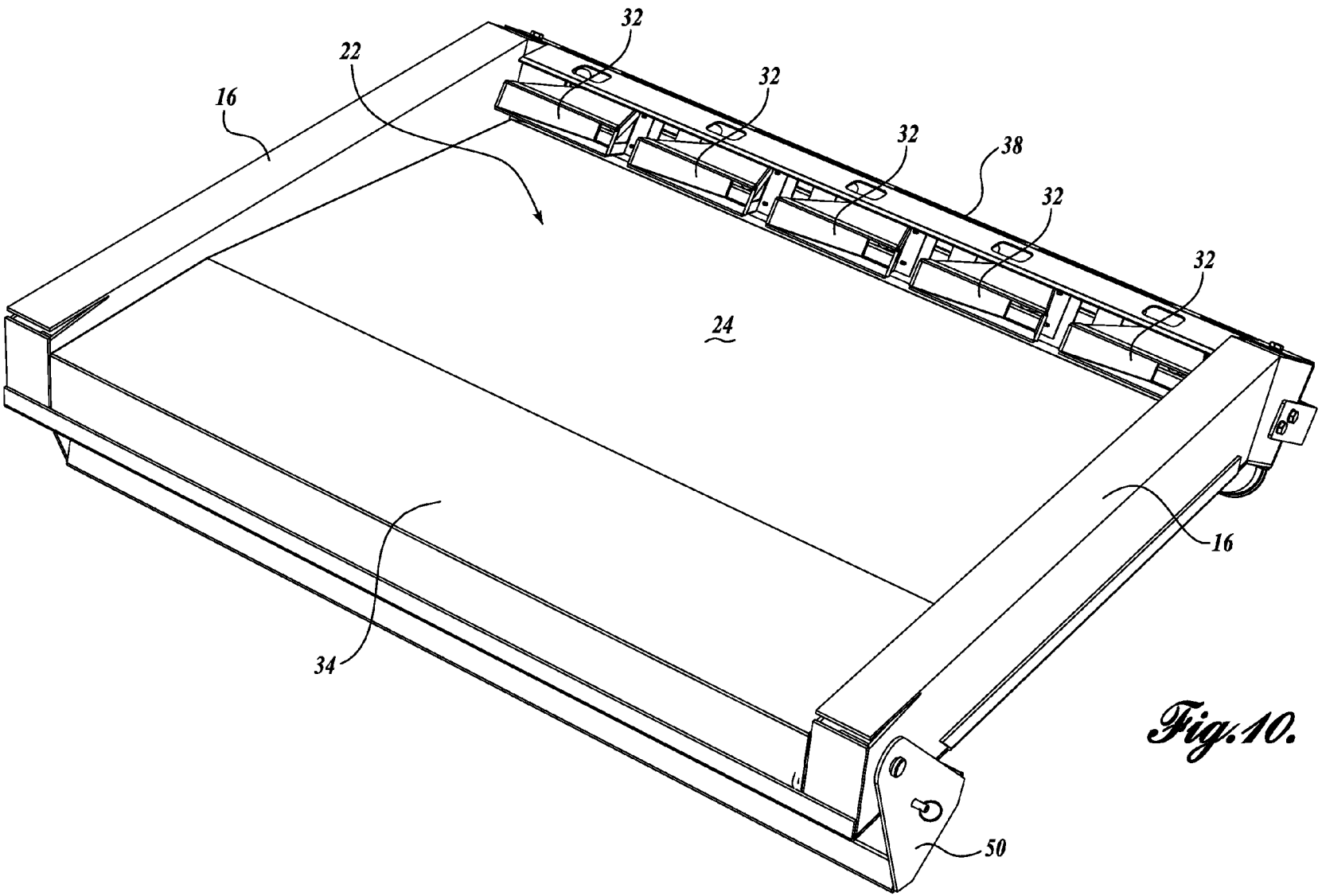
FIG. 10 is a bottom rear perspective view of the melting chamber of the ice resurfacer of FIG. 1.
Figure 11:
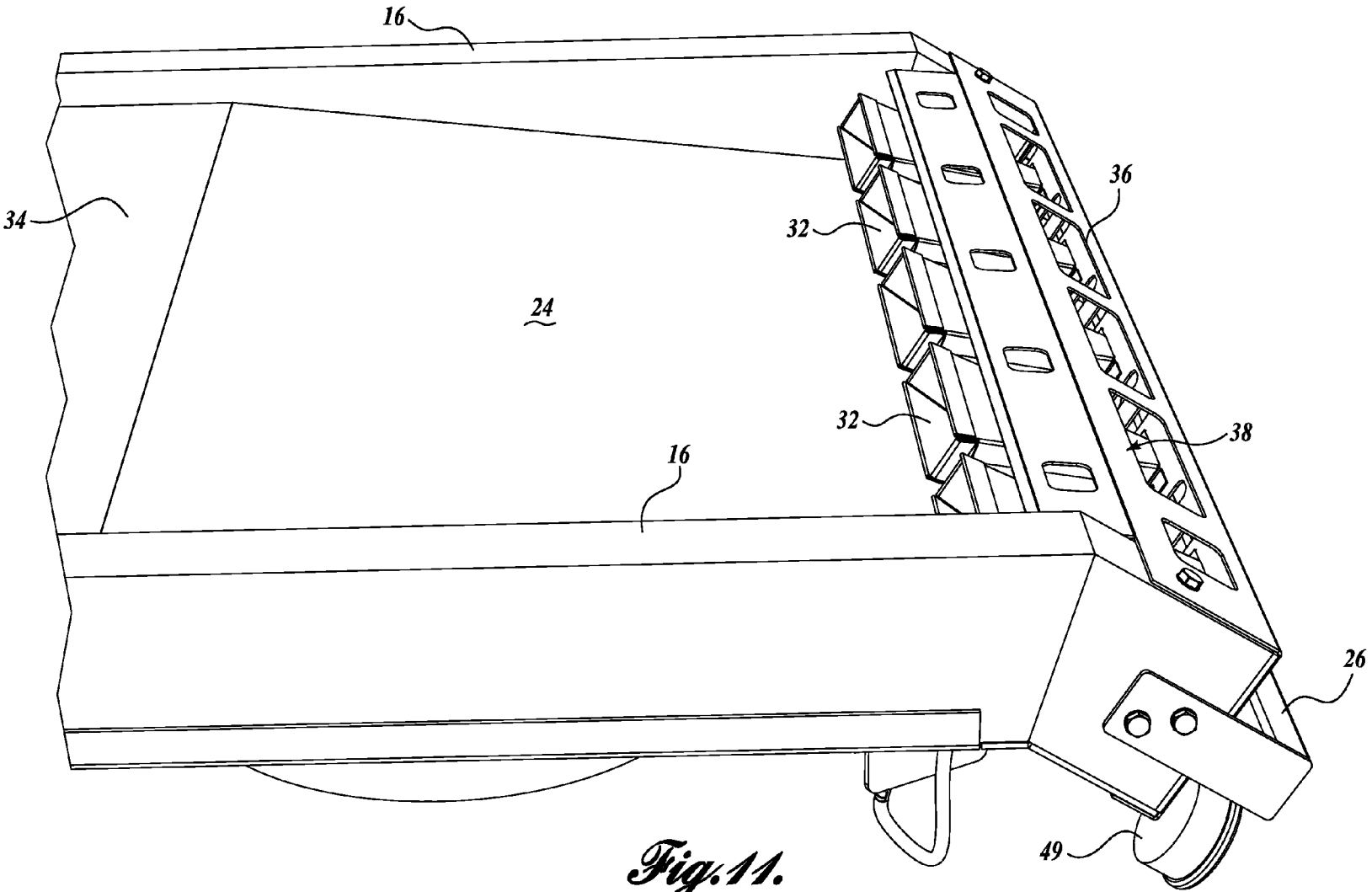
FIG. 11 is a side perspective view of the bottom of the ice resurfacer of FIG. 1.

As seen in the inverted view of melting chamber 22 in FIG. 10, top surface 24 of the melting chamber is sloped with respect to runners 16 such that the cross-sectional area of the melting chamber defined by top surface 24, lateral runners 16 and the ice surface, decreases as the hot gas moves away from expansion chamber outlets 32 toward chamber exit 34. The downwardly sloping top surface 24 may be a smooth curve or a series of bends. It has been found that the use of heavy 310-gauge stainless steel for the top surface of the melting chamber and for the expansion chambers 30 allows them to better withstand the extreme heat of the burn process. The reducing cross-sectional area of the melting chamber helps maintain the speed of the flow of hot gas rearwardly across the ice. Maintaining the velocity of the hot gas helps prevent the speed of the gas from stalling out as it cools or encounters a tail wind. The shape of the melting chamber thus allows optimum heat to be applied to the ice for melting throughout the passage of gas through the melting chamber.

Figure 9:
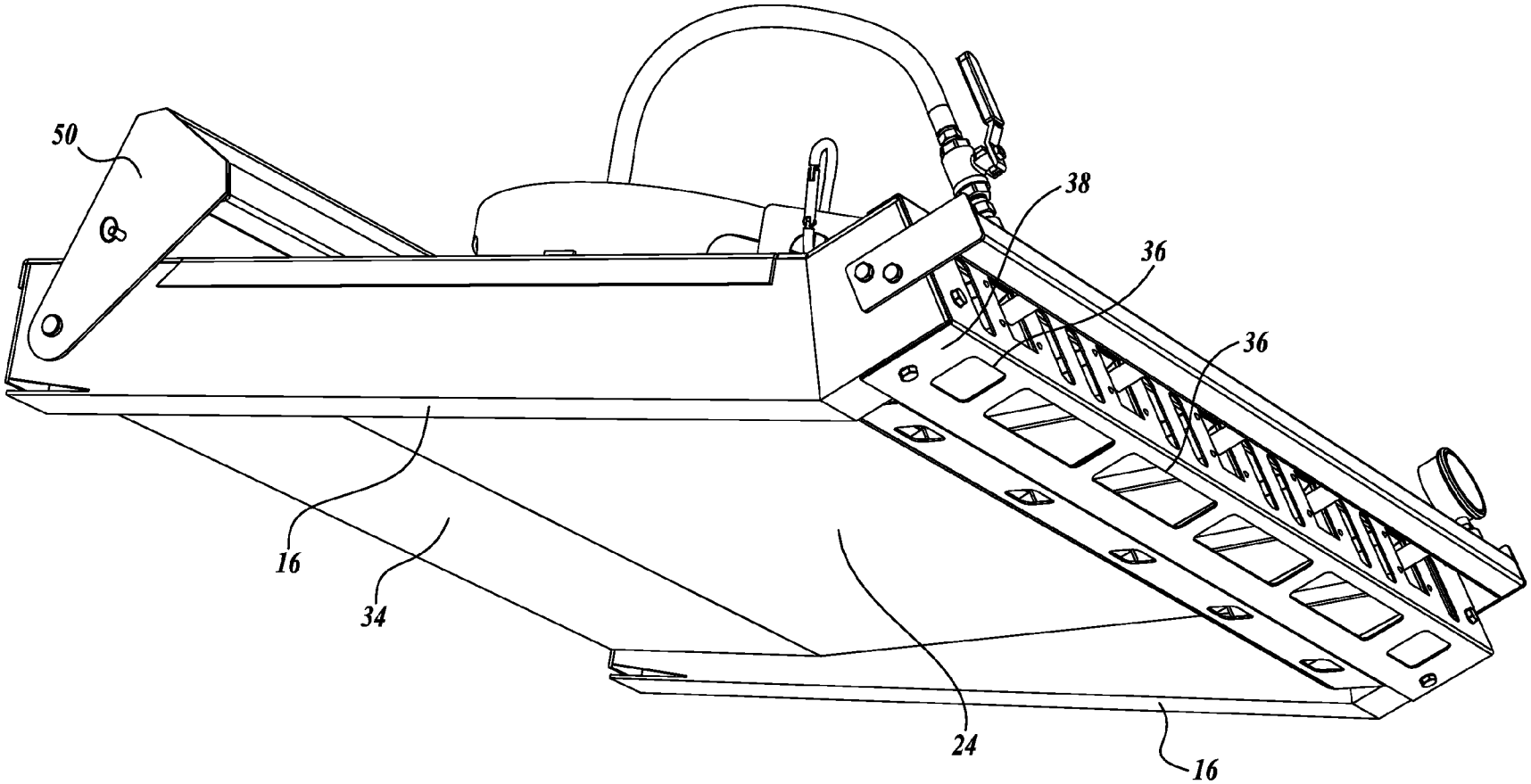
FIG. 9 is a right side perspective view of the ice resurfacer of FIG. 1 showing the rear windscreen rotated upwardly.

Referring again to FIG. 5 and to FIG. 9, openings 36 are shown positioned along the upwardly turned front wall 38 of the sled 12 to supply air to the area adjacent the orifices to promote complete combustion of the gas thus ensuring that the temperature of the combustion gas is as hot as possible when it first encounters ice under the melting chamber 22. The propane is fully burned near the front end of the sled such that the resultant heated combustion gas flows across the ice through the melting chamber 22 and out exit 34. The hot gas is in thermal contact with the ice as it travels rearwardly, thus causing the ice surface to melt and the gas to cool.

It will be understood that if too small an amount of propane is provided to the nozzles 28 to be burned, the combustion gas will cool quickly to the ice temperature thus reducing the melting ability of the device. As the amount of fuel burned is increased, more heat is produced and the combustion gas maintains its melting capability for a longer time so that the gas exhaust temperature at exit 34 of the sled rises. If excess fuel is burned, the exhaust gas is overly hot when it exits the melting chamber 22, thus increasing the speed of ice melting but losing fuel efficiency. Since gas economy and melting efficiency depend on the temperature of the gas in contact with the ice, the gas outflow from the propane tanks 20 is monitored so that the amount of fuel burned keeps the gas hot as it passes through the melting chamber 22, but is relatively cool as it exits the chamber 22. This allows melting to be carried out both economically and at a reasonable speed.

Turning, again, to FIG. 3, pressure regulator 40 is shown positioned in the path of flow of the propane gas from a pair of tanks 20 (FIG. 1), through fittings or connectors 42 and short hoses 44. The hand-tightened connectors 42 are selected to produce the flow of gas needed to provide the appropriate melting temperature. Connectors capable of producing a gas flow designed for a maximum output of 500 BTUs works well. It has been found that a 5 psi pressure regulator produces an efficient gas flow from a pair of 20-pound propane tanks, although it will be understood that pressure regulators of greater or lesser size may be effectively used with appropriate modification of other elements in the gas delivery system such as the size of the nozzles 28.

Referring additionally to FIG. 1, after leaving pressure regulator 40, the gas flows through long hose 46 to one end of manifold 26. Valve 48 is shown mounted at the gas entrance point to the manifold 26 to control the flow of gas to be burned. Pressure meter 49 is provided to monitor the gas pressure at the distal end of manifold 26 to ensure that adequate amounts of gas are provided to all of the nozzles 28.

Turning to FIG. 9, windscreen 50 is shown mounted on the rearward end of sled 12 for rotation between the upward position shown in FIG. 9 and the lowered position shown in FIG. 1. Windscreen 50 helps stabilize the flow of hot combustion gas from its entrance into the melting chamber 22 at the front of sled 12 to its discharge at the rear exit 34 of the melting chamber. Windscreen 50 helps prevent tail winds from disrupting the flow of gas out the rear exit 34 of the melting chamber 22, which would reduce melting efficiency or even create fire hazards if the exiting gases are pushed back into the melting chamber. When lowered into contact with the ice, windscreen 50 also spreads the melt water into a thin layer, allowing it to refreeze quickly and levelly. When operated along the curved corner boards of a rink, windscreen 50 is rotated upwardly, thus shortening the length of the ice resurfacer to allow it to better conform to the curved edge of the rink so that the ice surface is melted all the way to the sideboards of the rink. The windscreen also acts as a lifting handle when the unit cools.

Figure 12:
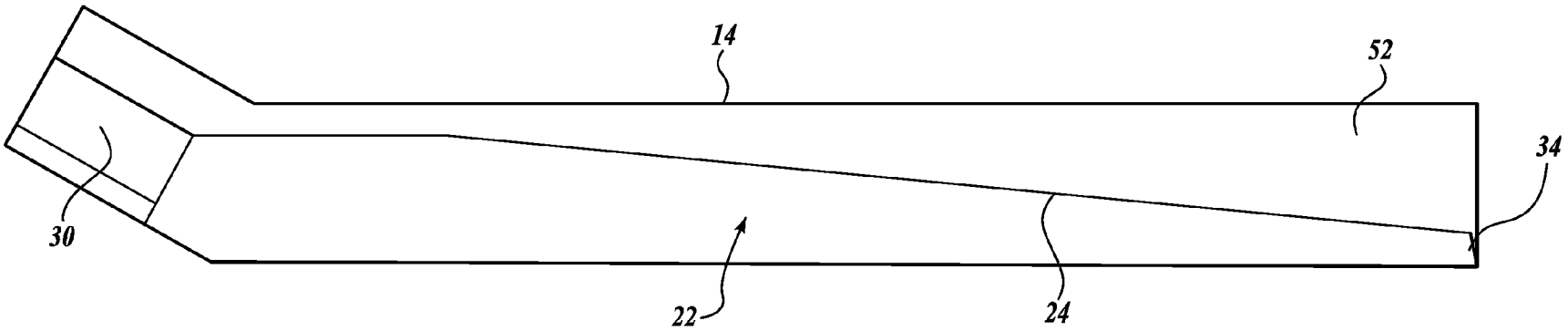
FIG. 12 is a schematic side elevation view of a section of the melting chamber of FIG. 11 showing the rearward, downward taper of the top surface of the melting chamber.

Referring to FIG. 12, a longitudinal cross section of melting chamber 22 illustrates one embodiment of the slope of top surface 24 of the melting chamber showing its downward slope toward outlet exit 34. Insulation such as a ceramic fiber blanket may be provided in the space 52 between the top plate 14 of the sled and the top surface 24 of the melting chamber to limit the amount of heat transmitted upwardly to the bottoms of the propane tanks 20 to prevent overheating of the tanks, and also to prevent heat damage to the top plate and reduce the possibility of operator contact burns.

While the preferred embodiment of the invention has been illustrated and described, it will be appreciated that various changes can be made therein without departing from the spirit and scope of the invention.

The invention claimed is:

1. A portable ice resurfacer for resurfacing a sheet of ice, the resurfacer comprising:

a sled having a top plate and a pair of opposed parallel runners, wherein said sled defines a volume between said opposed runners that cooperatively with the sheet of ice defines a melting chamber having as front entry and a rear exit;

a bracket for mounting at least one tank containing a combustible fuel to said top plate;

a manifold disposed at a forward end of said sled, wherein said manifold is configured to be fluidly connected to said at least one tank; and a plurality of nozzles fluidly connecting said manifold to said front entry of said melting chamber, such that ignition of combustible fuel exiting said nozzles will direct combustion gases into said melting chamber front entry, wherein the plurality of nozzles are configured to be angled with respect to the sheet or ice, such that the combustion gasses are directed to flow from the front entry toward the rear exit of the melting chamber;

wherein said melting chamber slopes downwardly from said front entry to said rear exit such that said rear exit has a smaller area than said front entry of said melting chamber.

2. The portable ice resurfacer of claim 1, further comprising a plurality of expansion chambers, each expansion chamber receiving the combustion gasses from an associated one of said plurality of nozzles, wherein said expansion chambers expand the combustion gases horizontally and further direct the combustion gasses from the front entry toward the rear exit of the melting chamber.

3. The portable ice resurfacer of claim 1, further comprising a fuel tank mounted to said top plate, said fuel tank being configured to selectively deliver a combustible fuel to said manifold.

4. The portable ice resurfacer of claim 3, wherein said fuel tank comprises a propane tank.

5. The portable ice resurfacer of claim 3, further comprising a second fuel tank mounted tri said top plate, said second fuel tank being configured to selectively deliver a combustible fuel to said manifold.

6. The portable ice resurfacer of claim 5, further comprising a hose assembly fluidly connecting said fuel tanks to said manifold, wherein said hose assembly includes gas pressure regulator means.

7. The portable ice resurfacer of claim 3, further comprising insulation disposed between said melting chamber and said top plate.

8. The portable ice resurfacer of claim 3, further comprising a windscreen mounted to said sled and positionable to screen tail wind from said melting chamber rear exit.

9. The portable ice resurfacer of claim 3, further comprising means for manually towing said ice resurfacer over said sheet of ice.

10. The portable ice resurfacer of claim 9, wherein said means for manually towing said ice resurfacer over said sheet of ice comprises at least one flexible guideline that is attached to the sled.

11. The portable ice resurfacer of claim 3, wherein said bracket for mounting at least one tank containing a combustible fuel to said top plate is configured to selectively retain any of one, two and three fuel tanks.

12. An ice resurfacing sled comprising a top plate, a pair of runners extending downwardly therefrom, and a melting chamber open to the ice to be resurfaced;

said melting chamber including a forward end having a plurality of burning gas nozzles, configured to direct hot combustion gas into the melting chamber and toward a rear gas exit, a pair of sidewalls and a top surface below the top plate of said sled;

said melting chamber top surface sloping downwardly from said forward end toward said rear gas exit such that the cross-sectional area of said melting chamber is reduced from its forward end toward its rear gas exit end;

where each nozzle is configured to direct combustion gasses into an associated expansion chamber, wherein each expansion chamber is configured to expand the combustion gasses in a plane and to direct the combustion gas at an oblique angle toward the ice and toward the rear gas exit.

13. The ice resurfacing sled of claim 12, including a fuel source mounted above said melting chamber, said fuel source being connected to a fuel distribution manifold positioned adjacent said expansion chambers, said manifold including a plurality of orifices directing fuel to be burned into said expansion chambers.

14. The ice resurfacing sled of claim 13, wherein said fuel source comprises a propane tank mounted on said ice resurfacing sled top plate, said propane tank being fluidly connected to said fuel distribution manifold by hose means.

15. The ice resurfacing sled of claim 13, wherein said fuel source comprises a plurality of propane tanks mounted on said ice resurfacing sled top plate, and further comprising hose means configured to carry a gas from said tanks to said fuel distribution manifold; and a gas pressure regulator means interconnected with said hose means to control the pressure of said gas carried from said tanks to said manifold.

16. The ice resurfacing sled of claim 12, wherein an inner surface of each of said pair of runners comprises said sidewalls of said melting chamber.

17. The ice resurfacing sled of claim 16, wherein said top surface of said melting chamber extends between said sidewalls below said sled top plate, said top surface sloping downwardly from said forward end toward said rear gas exit end to define a space between said top surface and said top plate, and further comprising insulation disposed in said space.

18. The ice resurfacing sled of claim 12, including a windscreen mounted adjacent said rear gas exit end of said melting chamber.

* * * * *

UNITED STATES PATENT AND TRADEMARK OFFICE

CERTIFICATE OF CORRECTION

PATENT NO. : 8,443,530 B2
APPLICATION NO. : 12/940899
DATED : May 21, 2013
INVENTOR(S) : J. G. Pender It is certified that error appears in the above-identified patent and that said Letters Patent is hereby corrected as shown below:

| | LINE | ERROR |
|---|---|---|
| Title Page Item (73) Col. 1 | Assignee | "**Holaday-Parks-Fabricators, Inc.,**" should read --**Holaday-Parks-Fabricators, Inc., dba Holaday-Parks, Inc.,**-- |

In the Claims

| | | |
|---|---|---|
| Col. 6 (Claim 5, | 20 line 2) | "tri" should read --to-- |

Signed and Sealed this
Fifteenth Day of April, 2014

Michelle K. Lee

Michelle K. Lee
*Deputy Director of the United States Patent and Trademark Office*